US007413457B2

(12) United States Patent
Mehnert et al.

(10) Patent No.: US 7,413,457 B2
(45) Date of Patent: Aug. 19, 2008

(54) ELECTRICAL CONNECTOR AND ELECTRICAL PLUG AND SOCKET CONNECTION

(75) Inventors: Wolfgang Mehnert, Lindau (DE); Bernd Froese, Muelheim an der Ruhr (DE); Andreas Hartrampf, Kressbron (DE); Thomas Ohlinger, Wangen (DE)

(73) Assignee: i f m electronic GmbH, Essen (DE)

( * ) Notice: Subject to any disclaimer, the term of this patent is extended or adjusted under 35 U.S.C. 154(b) by 18 days.

(21) Appl. No.: 11/563,390

(22) Filed: Nov. 27, 2006

(65) Prior Publication Data

US 2007/0145744 A1 Jun. 28, 2007

(30) Foreign Application Priority Data

Nov. 25, 2005 (DE) ..... 10 2005 056 563

(51) Int. Cl.
*H01R 13/62* (2006.01)
*H01R 4/38* (2006.01)

(52) U.S. Cl. ..... 439/321; 439/312; 285/81

(58) Field of Classification Search ..... 439/321, 439/312, 313, 315, 320, 470; 285/81, 82
See application file for complete search history.

(56) References Cited

U.S. PATENT DOCUMENTS 5,376,015 A 12/1994 Fuchs et al.

FOREIGN PATENT DOCUMENTS

| | | |
|---|---|---|
| DE | 19721506 A1 | 11/1998 |
| DE | 19830659 C1 | 1/2000 |
| DE | 20313187 U1 | 2/2005 |

*Primary Examiner*—Javaid Nasri
(74) *Attorney, Agent, or Firm*—David S. Safran

(57) ABSTRACT

An electrical connector connects to a mating connector by a rotatable union nut that is axially displaceable on a contact carrier with a sealing element therebetween. Damage to the sealing element is prevented by a stop that limits the maximum path by which the union nut can be screwed onto the mating connector, such that when the union nut is screwed on, the elastic sealing element is intentionally compressed, but is not damaged or destroyed. A vibration guard can also be provided in the connection.

17 Claims, 9 Drawing Sheets

ELECTRICAL CONNECTOR AND ELECTRICAL PLUG AND SOCKET CONNECTION

BACKGROUND OF THE INVENTION

1. Field of the Invention

The invention relates to an electrical plug and socket connection with a connector and a mating connector.

2. Description of Related Art

Electrical plug and socket connections typically consist essentially of two parts, the electrical connector and the mating connector. Both the connector and the mating connector have a contact carrier with corresponding contacts, which are either contact pins or corresponding sockets. Depending on whether the contact pins or the sockets are located in the respective contact carrier, the pertinent connecting part is called a plug or a socket. For purposes of simplicity of description, and without the invention being limited thereto, it is assumed herein that the contact carrier of the connector has sockets, while the contact pins are located in the contact carrier of the pertinent mating connector. Of course, one of ordinary skill in the art would understand that the components may be reversed.

These electrical plug and socket connections and connectors are used in automation as a component of electronic equipment, sensors, actuators, and controls. In such connections, especially in connector models known as M12 and M8 connectors (i.e., standard connectors having a metric thread with a bore of 12 mm or 8 mm) in which three, four, five, eight or twelve contacts are widely used, electrical connectors or mating connectors are provided in a straight version and also in 90° bent version. In the latter version, the handle body of the electrical connector is bent by 90° so that between the lengthwise direction of the accommodated cable set and the lengthwise direction of the contacts an angle of 90° is formed. These electrical connectors and electrical plug and socket connections can either be freely fabricated or wired when finished, then the contact carrier and the cable set of the handle body are injected in place.

In the plug and socket connections, the method of connecting the connectors and the mating connectors to one another is known. For example, the connector may have a union nut that is screwed onto a thread, which has been formed on the outside sleeve of the mating connector. In this case, the union nut has an inside thread that corresponds to the thread of the mating connector. Alternatively, it is also possible for the union nut to have an outside thread so that the connector with the union nut can be screwed into the outside bushing of the mating connector, which has a corresponding inside thread.

Since these electrical connectors are often used in relatively rough industrial environments and they can be exposed both to vibrations and shaking as well as moisture or direct water spray, it is known to provide the connectors with a corresponding vibration guard, which is intended to prevent unintentional loosening of the union nut. Moreover, on the connector or the corresponding mating connector, a sealing element, generally a gasket, is provided that ensures reliable sealing of the contacts. Examples of electrical connectors with a vibration guard are disclosed in DE 42 05 440 C2, DE 197 21 506 A1, DE 198 30 659 C1 and DE 203 13 187 U1. The individual connectors differ in that the vibration guard is made with axial teeth or radial teeth. The teeth are generally formed between the union nut and the contact carrier.

One disadvantage in known connectors is that an increased expenditure of force is necessary due to the vibration guard when the union nut is screwed into or onto the outside sleeve of the mating connector. In practice, this often leads to the union nut being screwed tightly with a tool. As a result, the tightening moment can be so great that damage to the electrical connector, especially overly strong compression, i.e. "overpressing" of the elastic sealing element, occurs. "Overpressing" of the sealing element can lead to the sealing element being damaged so that the sealing element no longer maintains its sealing action or, in any case, no longer reliably and permanently maintains its sealing action.

SUMMARY OF THE INVENTION

An aspect of this invention is to provide an electrical connector and an electrical plug and socket connection, similar to that described above, in which the aforementioned disadvantages are avoided, especially where damage of the sealing element is prevented.

This aspect can be realized by providing a stop that limits the maximum path by which the union nut can be screwed onto the mating connector such that when the union nut is screwed on, the elastic sealing element is compressed as desired, but is not damaged or destroyed. The stop in accordance with this invention thus forms a protective mechanism against "overpressing" of the sealing element. The stop also limits the maximum compressive force on the sealing element to an allowable value even with a large tightening moment.

In a first configuration of the invention, the stop is implemented by a corresponding geometrical configuration of the electrical connector. The stop can be made either on the inside surface of the union nut or on the outside periphery of the contact carrier. In two versions disclosed herein, the stop limits the maximum screw-down path of the union nut, by which it is ensured that a given axial distance between the second face side of the collar on the contact carrier and the face side of the mating connector is maintained. The space between the face side of the mating connector and the second face side of the collar of the contact carrier, which is limited in the radial direction by the contact carrier and the inside of the union nut, then can not fall below a given value. A return space is formed for the elastic sealing element, with this return space being dimensioned such that on the one hand the desired compression of the sealing element occurs, so that it performs its sealing function, but on the other hand "overpressing" of the sealing element is prevented.

According to one alternative configuration, the stop is formed by an additional component that is located at least partially between the contact carrier and the union nut, and its face side in the mounted state of the connector and mating connector interacts with the mating connector, especially with its face side. The maximum screw-down path of the union nut is thus determined by the dimensions of the additional component. The maximum screw-down path of the union nut is reached when the face side of the additional component strikes the face side of the mating connector.

Both in the initially described configuration of the invention in which the stop is made on the inside surface of the union nut or on the outer periphery of the contact carrier and also in the alternative configuration in which an additional component is used, it is preferable that the electrical connector is provided with a vibration guard. To implement the vibration guard in the first embodiment, an open spring washer or retaining ring is located in a twist-proof manner on the contact carrier and interacts with the union nut such that the required force when the union nut is screwed tightly onto the thread of the mating connector is less than required when unscrewing.

In the second embodiment, the vibration guard is formed by the additional component and the union nut. In this case, the vibration guard is made such that the required force when the union nut is screwed tight is less than in unscrewing. The additional component is thus used both as a stop for limiting the maximum screw-down path and also as a vibration guard. The additional component is preferably made of metal so that even when the union nut which likewise consists of metal is repeatedly screwed down and unscrewed, the vibration guard does not wear. The vibration guard implemented between the additional component and the union nut is thus durable and resists wear.

There are multiple possibilities for how the additional component can be made. In one version, the additional component is made as an open or closed ring, with the ring being connected tightly to the sealing element, especially by injecting around the sealing element or by being injected with the sealing element. The ring and the sealing element in the mounted state of the connector and mating connector are located between the collar of the contact carrier and the mating connector, especially its face side. The ring and the sealing element form a structural unit, with the minimum axial extension of the return space for the elastic sealing element being dictated by the axial extension of the ring, i.e. its width.

In another version, the additional component is made as a stop ring or a stop sleeve, with the stop ring or stop sleeve being located on the contact carrier and each having a shoulder that extends behind the first face side of the contact carrier. At the stop ring, the shoulder simultaneously forms the second face side, i.e. the second end of the stop ring, while the stop sleeve has two sections with different diameters that are connected to one another by the shoulder. The shoulder is thus located in the middle region of the stop sleeve.

As described above, in this connection the additional component, i.e. the stop ring or stop sleeve, is part of the vibration guard. In this regard, it is preferable that the stop ring or the stop sleeve is provided with axially and/or radially projecting, ramp-shaped projections or spring tongues. These form a direction-dependent vibration guard together with the union nut. In this case, the stop ring and the stop sleeve are preferably made of metal. The ramp-shaped projections or spring tongues on the one hand enable the union nut to be screwed down relatively easily, while on the other hand, when unscrewing in the opposite direction, the steep angle of the projection or spring tongue makes loosening difficult.

The vibration guard is preferably further improved in that the end-side shoulder of the union nut has teeth or knurling that project toward the inside. Depending on the configuration of the corresponding opposing teeth on the spring washer or retaining ring and on the stop ring or the stop sleeve, the teeth can be made symmetrical or asymmetrical on the union nut. The teeth on the union nut and the corresponding opposing teeth on the spring washer or retaining ring and on the stop ring or the stop sleeve form a type of ratchet so that reaching the end position, i.e. screwing down the union nut tight, can also be acoustically recognized.

In accordance with the invention, the electrical plug and socket connection includes a connector having a handle body that surrounds a cable set, a contact carrier and a union nut, which is rotatable and can be axially displaced to a limited degree on the contact carrier. The electrical plug and socket connection also includes a mating connector that has an outer sleeve with an inside thread, a mating contact carrier, and an elastic sealing element, which is located on the mating contact carrier on the thread base. The union nut can be screwed into the inner thread of the mating connector. The contact carrier has a peripheral collar with a first face side, which is used as a stop for an end-side shoulder of the union nut, and a second face side, which faces the mating connector and is used as a stop for the sealing element. The sealing element in the mounted state of the connector and the mating connector is pressed by the collar of the contact carrier onto the thread base of the mating connector. A stop limits the maximum screw-in path of the union nut into the mating connector such that when the union nut is screwed in, the elastic sealing element is intentionally compressed, but is not damaged or destroyed.

The stop ensures that a sufficient return space for the sealing element is maintained. In this configuration of the electrical connector, the contact carrier has sockets, and on the contact carrier there is an elastic sealing element. In the electrical plug and socket connection for the connector so provided, it is also possible to provide the contact carrier with contact pins, while the sockets are located in the corresponding mating contact carrier of the mating connector. In that case, the elastic sealing element is located on the mating contact carrier of the mating contact element. A host of these mating connectors, which act as sockets, can be located for example in the corresponding cable splitting boxes.

In the electrical plug and socket connection in accordance with the invention, the stop is preferably implemented by a shoulder being formed on the thread base of the mating connector. The shoulder limits, on one hand, the maximum screw-in depth of the union nut, and, on the other hand, guarantees a sufficient return space for the elastic sealing element, so that the desired compression occurs, but without "overpressing" of the sealing element.

As has already been described in conjunction with the electrical connector, preferably the electrical plug and socket connection also has a vibration guard. In this case, the vibration guard is also made such that the required force when the union nut is screwed into the inside thread of the mating connector is less than when unscrewing. The vibration guard thus requires a different expenditure of force depending on the direction.

According to one preferred configuration, the connector also has a stop ring or a stop sleeve, which according to the preceding details is located on the contact carrier, on the stop ring or on the stop sleeve and resists torsional forces. Axially and/or radially projecting, ramp-shaped projections or spring tongues are also provided, which together with the union nut form a direction-dependent vibration guard.

There are multiple possibilities for embodying and developing the electrical connector in accordance with the invention and the electrical plug and socket connection in accordance with the invention.

DETAILED DESCRIPTION OF THE INVENTION

Figure 1A:
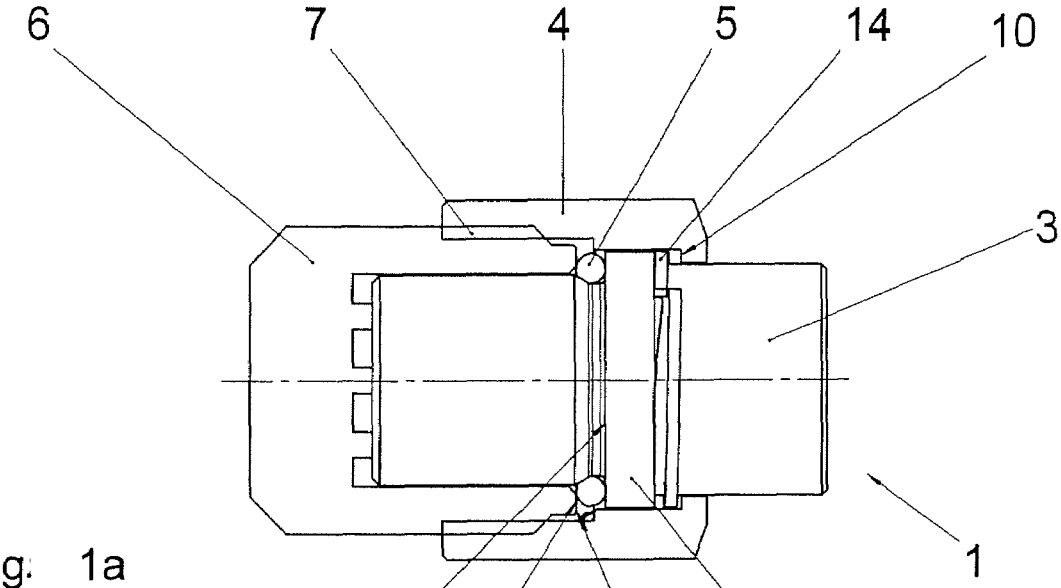
FIG. 1*a* shows a side view of a first embodiment of an electrical connector in accordance with the invention in the released state.

The figures show different versions of an electrical connector 1 and individual components of such an electrical connector 1, all in accordance with this invention. The electrical connector 1 has a handle body 2 (seen in FIG. 12), which surrounds a cable set (not shown), a contact carrier 3, a union nut 4 that is rotatable and axially displaceable to a limited degree on the contact carrier 3, and an elastic sealing element 5 that is located on the contact carrier 3 preferably in the form of a gasket. The electrical connector 1 can be connected to a corresponding mating connector 6 by screwing the union nut 4 onto a thread 7 formed on the outside sleeve of a mating connector 6.

As is apparent from FIGS. 1 to 7, the contact carrier 3 has a peripheral collar 8 which is located roughly in the middle area of the contact carrier 3. The peripheral collar 8 has a first face side 9, which is used as a stop for an end-side shoulder 10 of the union nut 4. By this arrangement, when the union nut 4 is screwed onto the thread 7 of the mating connector 6, the axial motion of the union nut 4 is transmitted to the contact carrier 3, by which the contact carrier 3 is pushed into the mating connector 6. The second face side 11 of the collar 8 facing the mating connector 6 is used as a stop for the sealing element 5, which is located on the contact carrier 3. So, the sealing element 5 in the mounted state of the connector 1 and the mating connector 6 is located between the collar 8 of the contact carrier 3 and a face side 12 of the mating connector 6, such that the sealing element 5 is intentionally compressed. By this, the desired sealing between the connector 1 and the mating connector 6 is achieved.

Depending on the tightening moment with which the union nut 4 of the connector 1 is screwed onto the corresponding thread 7 of the mating connector 6, the elastic sealing element 5 is more or less strongly compressed. When the union nut 4 is screwed tight using a tool, "overpressing" of the sealing element 5 can occur, by which the sealing element 5 can be damaged. To reliably prevent this "overpressing" of the elastic sealing element 5, in accordance with the invention, a stop 13 is provided that limits the maximum screw-down path of the union nut 4 on the mating connector 6 so that when the union nut 4 is screwed down the elastic sealing element 5 is intentionally compressed, but not pressed or compressed so strongly that the sealing element 5 is damaged or destroyed.

Figure 1B:
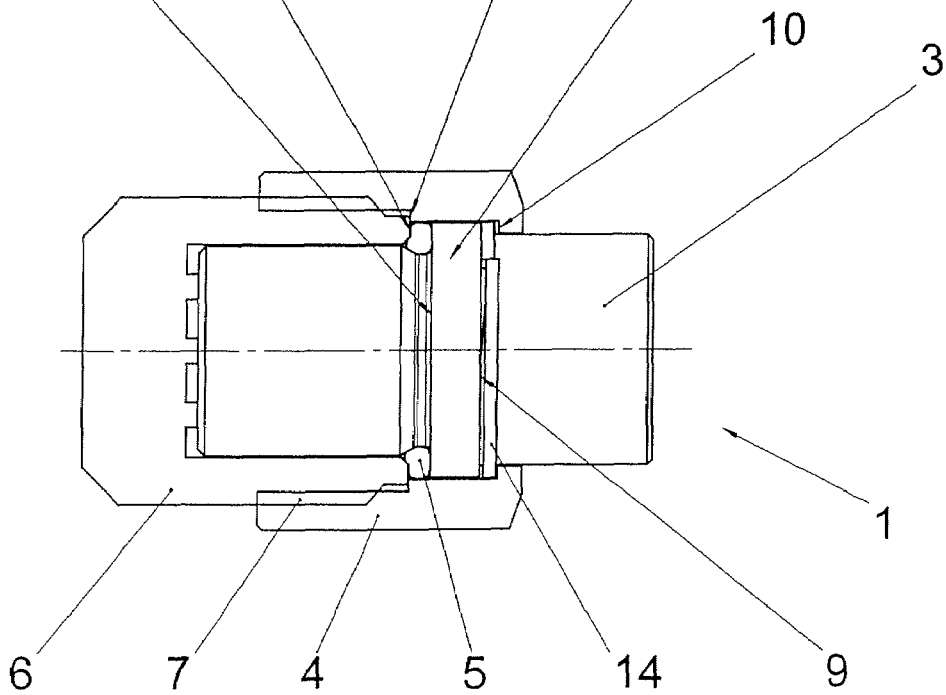
FIG. 1*b* shows a side view of the first embodiment of an electrical connector of FIG. 1*a* in accordance with the invention in the tightly screwed state.

In the embodiment as shown in FIG. 1, the stop 13 is formed on the inside surface of the union nut 4. The union nut 4 thus has a shoulder, which serves as the stop 13, that adjoins the face side 12 of the mating connector 6 in the tightly screwed state of the union nut 4, as seen in FIG. 1*b*. By this, further screwing down of the union nut 4 and thus further compression of the sealing element 5 is prevented. By a corresponding choice of the position of the stop 13, i.e. of the shoulder on the inside surface of the union nut 4, maximum compression of the elastic sealing element 5 can thus be easily established. FIG. 1*a* shows the state when the union nut 4 has still not yet been completely screwed down onto the mating connector 6, and the sealing element 5 is not yet compressed. FIG. 1*b* shows the state in which the union nut 4 is screwed entirely onto the mating connector 6, and the sealing element 5 is compressed at this point so that it performs its sealing function. As a result of the stop 13 on the inside surface of the union nut 4, the union nut 4 however cannot be further screwed down so that damaging "overpressing" of the sealing element 5 does not occur.

Figure 2A:
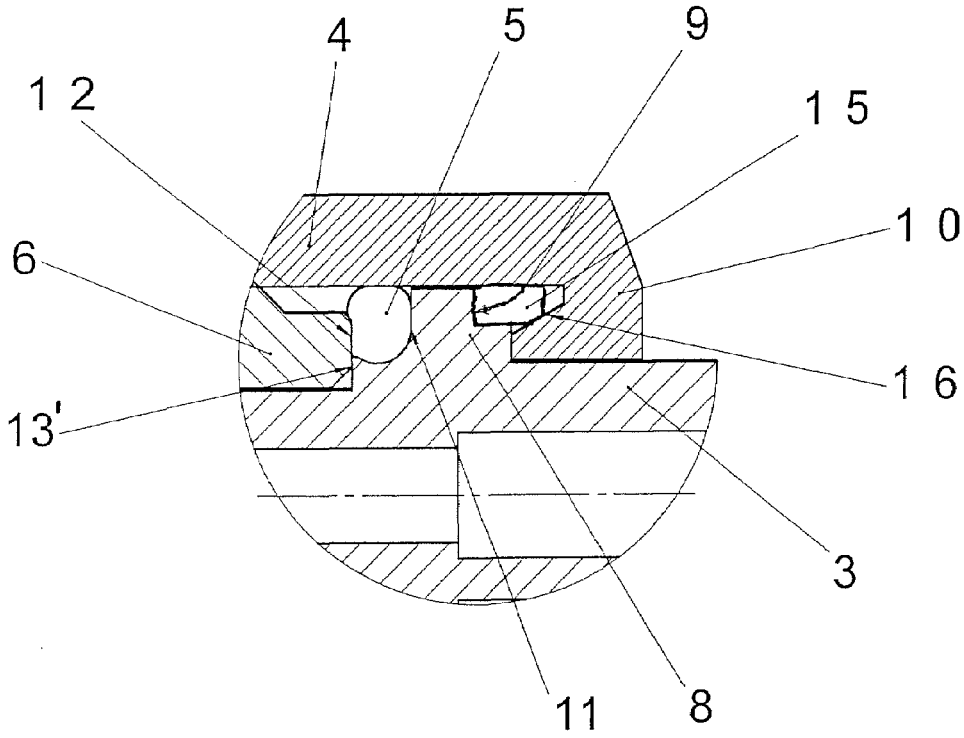
FIG. 2*a* shows an enlarged side view in cross section of an alternative embodiment of the electrical connector shown in FIG. 1*a;*
Figure 2B:
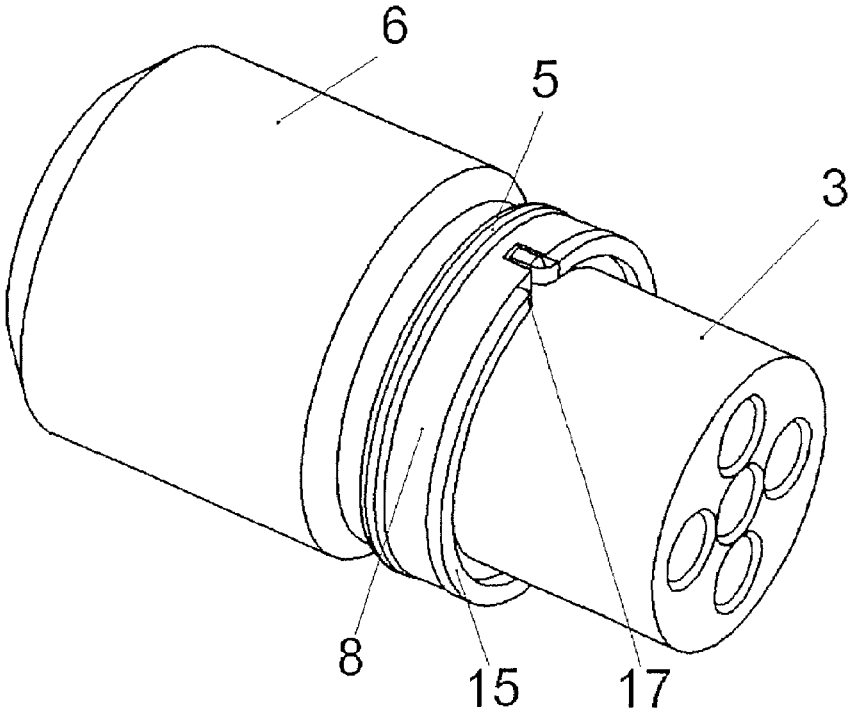
FIG. 2*b* shows a side perspective view of the configuration of FIG. 2*a;*

In an alternative configuration shown in FIGS. 2*a* and 2*b,* the stop 13' is formed on the outer periphery of the contact carrier 3. Thus, the contact carrier 3 has a shoulder, which in the tightly screwed state of the union nut 4 (seen in FIG. 2*a*), adjoins the face side 12 of the mating connector 6. In this way, the maximum screw-down path of the union nut 4 is limited, by which overpressing of the sealing element 5 is prevented. The stop 13' ensures that a given distance between the face side 11 of the collar 8 and the face side 12 of the mating connector 6 is always maintained, even in the tightly screwed state of the electrical connector 1. Thus, a return space for the elastic sealing element 5 is formed, which in the axial direction is limited by the face side 11 of the collar 8 and the face side 12 of the mating connector 6 and which in the radial direction is limited by the outside surface of the contact carrier 3 and the inside surface of the union nut 4.

In the electrical connector 1 as shown in FIGS. 1*a* and 2*a,* a vibration guard is also provided. In the embodiment of FIG. 1*a,* the vibration guard is implemented by an open spring washer 14, and in the embodiment of FIG. 2*a,* the vibration guard is implemented by an open retaining ring 15, each forming a retaining element that interacts with the union nut 4. The spring washer 14 and the retaining ring 15 can have either a round or a square cross section and can preferably be made of metal. By forming an overlapping portion of the spring washer 14 or a corresponding overlapping arrangement or mounting of the spring washer 14 on the contact carrier 3, direction-dependent torsion protection or a direction-dependent vibration safeguard is implemented so that the required force when the union nut 4 is screwed tightly onto the thread 7 of the mating connector 6 is less than when the union nut 4 is unscrewed.

In the electrical connector 1 shown in FIG. 2*a*, the end-side shoulder 10 of the union nut 4 has a conical surface 16 that engages the retaining ring 15 when screwed tight. Direction-dependent torsion protection is achieved because the retaining ring 15 has a sharp-edged end 17 that "clings" to the conical surface 16 of the union nut 4 when the union nut 4 is unscrewed so that a greater friction moment must be overcome than when the union nut 4 is screwed tight.

While in the two embodiments shown in FIGS. 1*a*, 1*b*, 2*a*, and 2*b*, the stop 13, 13' is made on the union nut 4 or on the contact carrier 3, in the subsequent embodiments described herein the stop is formed by an additional component.

Figure 3B:
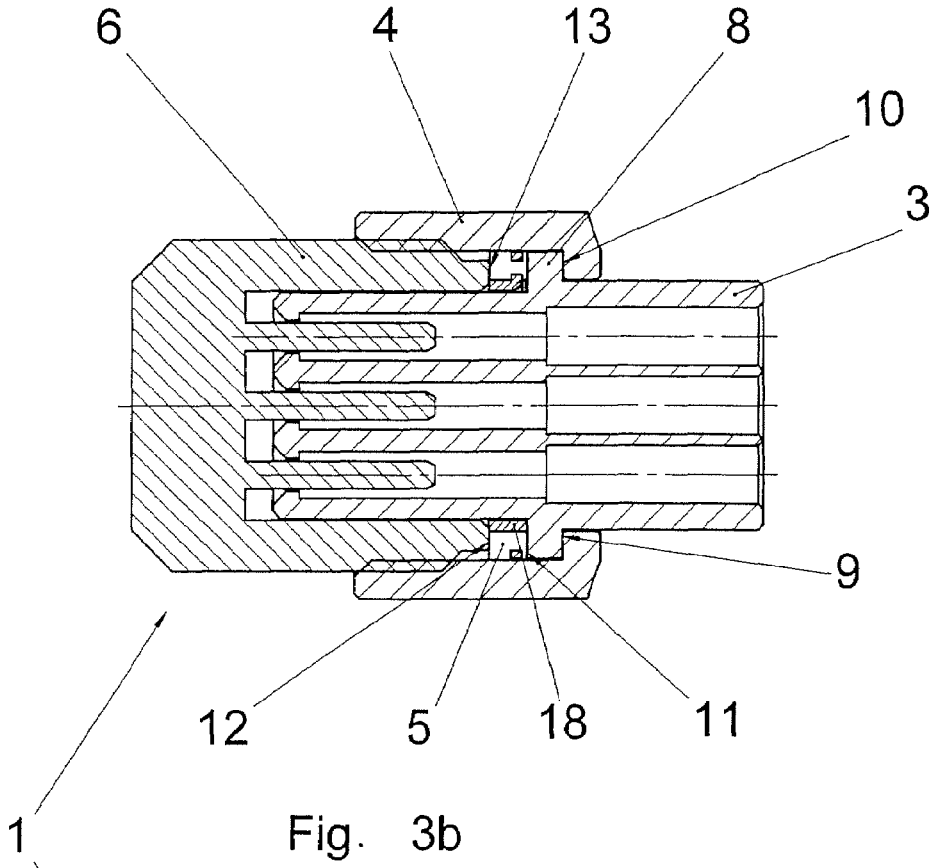
FIG. 3*b* shows the second embodiment of an electrical connector in accordance with the invention in a tightly screwed state.
Figure 3A:
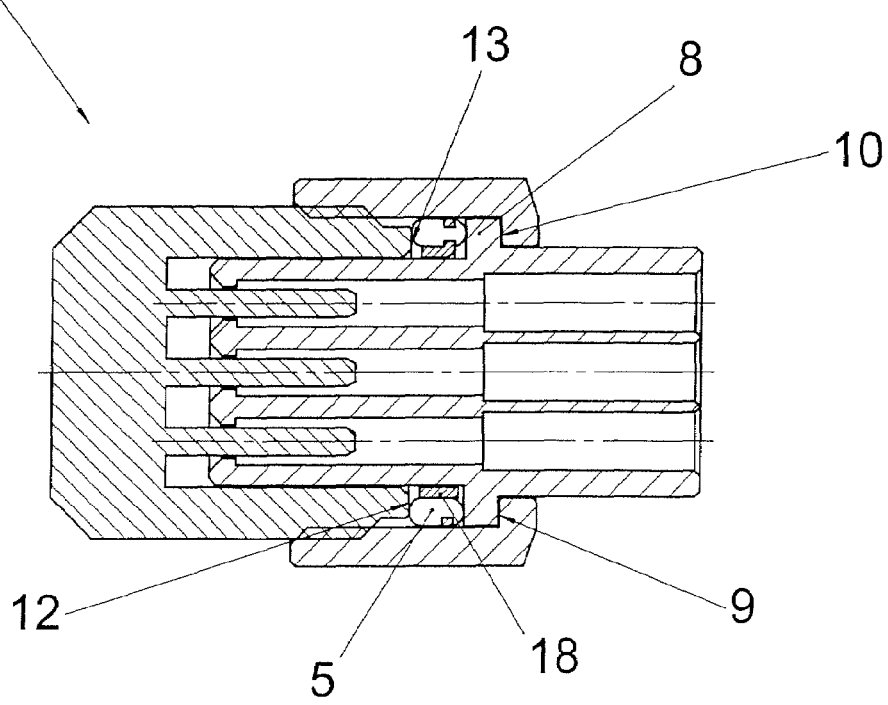
FIG. 3*a* shows a second embodiment of an electrical connector in accordance with the invention in a released state.
Figure 4B:
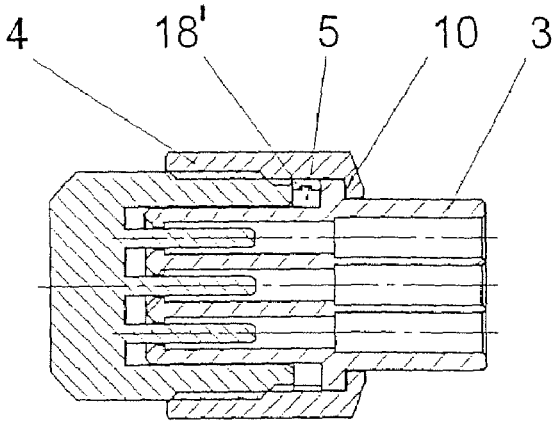
FIG. 4*b* shows the alternative embodiment of the electrical connector shown in FIG. 3*a* in a screwed state.
Figure 4A:
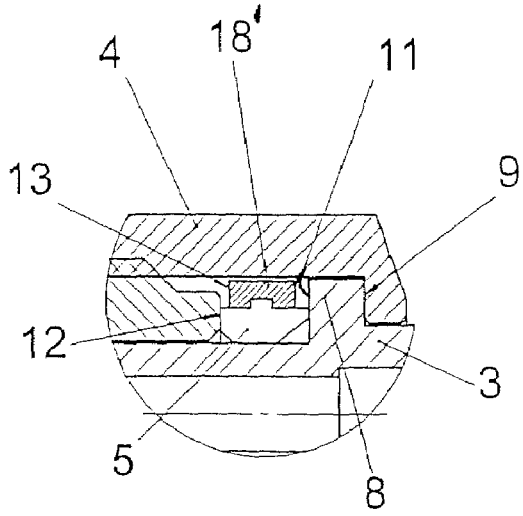
FIG. 4*a* shows an alternative embodiment of the electrical connector shown in FIG. 3*a* in a released state.

In the two embodiments shown in FIGS. 3*a*, 3*b*, 4*a*, 4*b*, and 4*c*, the additional component is made as a ring 18. The ring 18 is connected to the sealing element 5 by injection around the sealing element 5 (as seen in FIGS. 3*a* and 3*b*) or by injection with the sealing element 5 (as seen in FIGS. 4*a* and 4*b*). The ring 18 and the sealing element 5 in the mounted state of the connector 1 and mating connector 6 are located between the collar 8 of the contact carrier 3 and the mating connector 6, especially at its face side 12. If the union nut 4 is now screwed tight, the sealing element 5 is compressed until the ring 18 on the one hand adjoins the face side 11 of the collar 8, and on the other hand, the face side 12 of the mating connector 6. The ring 18 may be made of metal. The ring 18 further prevents the union nut 4 from being screwed further onto the mating connector 6, by which "overpressing" of the sealing element 5 is reliably prevented.

Figure 4C:
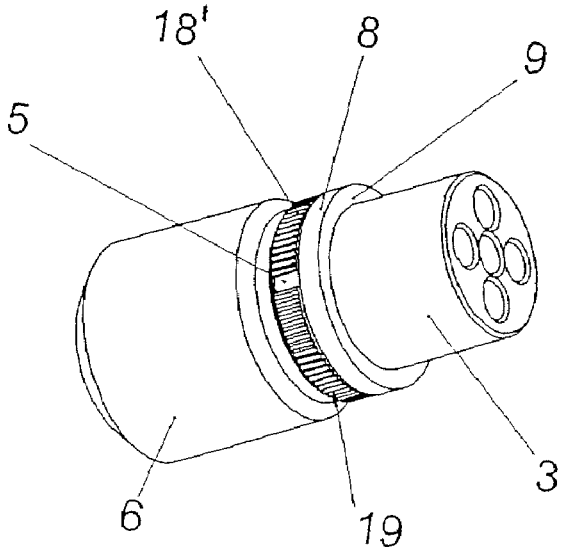
FIG. 4*c* shows a side perspective view of the electrical connector shown in FIGS. 4*a* and 4*b* without the nut.

In the embodiment shown in FIGS. 4*a*, 4*b*, and 4*c*, it is apparent that the ring 18' is made as an open ring that radially surrounds the sealing element 5 so that the ring 18' widens when the sealing element 5 is being compressed. Ribs 19 are formed on the outer periphery of the ring 18'. So, the knurled ring 18' simultaneously acts as torsion protection. FIG. 4*c* shows the electrical connector 1 together with the mating connector 6 without the union nut 4. In this view, the knurling on the outer periphery of the ring 18' can be easily recognized.

A certain torsion protection is also achieved in the embodiment of FIGS. 3*a* and 3*b* since when the union nut 4 is tightened the sealing element 5 is pressed radially against the inside surface of the union nut 4, by which a corresponding friction force is produced. FIG. 3*a* shows the detached state, while in FIG. 3*b* the tightly screwed state is shown. Similarly, FIGS. 4*a* and 4*b* show the detached and tightly screwed states, respectively.

Figure 5B:
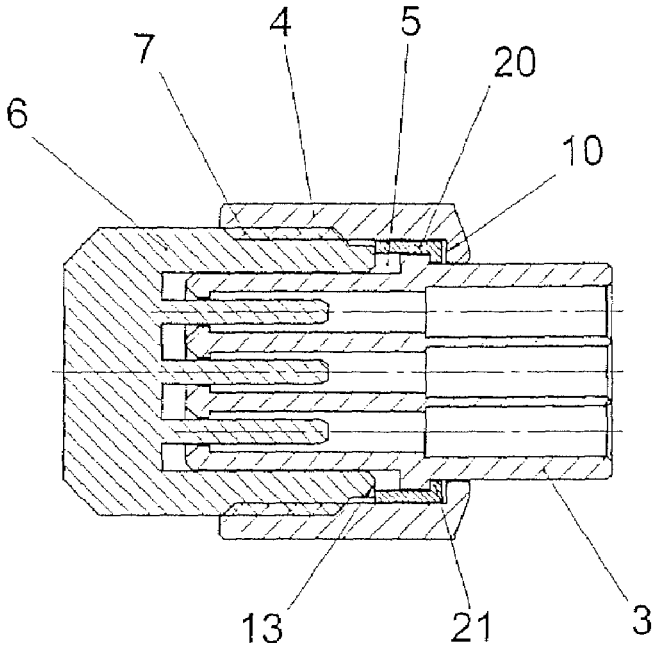
FIG. 5*b* shows a side view in section of the embodiment of the electrical connector of FIG. 5*a* in accordance with the invention in a screwed state.
Figure 5A:
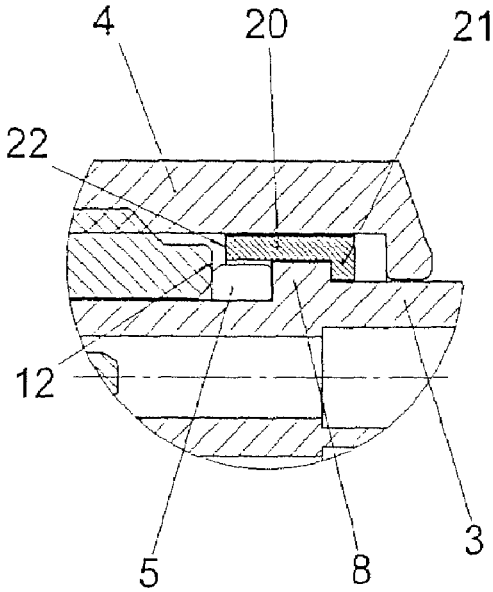
FIG. 5*a* shows an enlarged partial side view in section of another embodiment of an electrical connector in accordance with the invention in a released state.

FIGS. 5*a* and 5*b* show a version of an electrical connector 1 in which the stop ring is made as an additional component. A stop ring 20 is located on the contact carrier 3 and has an end-side shoulder 21 that extends behind the first face side 9 of the shoulder 8 and a face side 22 that extends beyond the second face side 11 of the collar 8 on the contact carrier 3. In contrast to the embodiments shown in FIGS. 3*a* and 4*a*, the stop ring 20 in the mounted state of the connector 1 and mating connector 6 is not located between the collar 8 of the contact carrier 3 and the mating connector 6, but rather is located between the shoulder 10 of the union nut 4 and the face side 12 of the mating connector 6. When the axial length of the stop ring 20 is fixed, the axial extension of the collar 8 over which the stop ring 20 extends must thus be considered. Here, the maximum screw-down path of the union nut 4 is also defined, i.e. further screwing down is no longer possible, when the face side 22 of the stop ring 20 adjoins the face side 12 of the mating connector 6, as seen in FIG. 5*b*. The stop ring 20 then extends over the sealing element 5 so that a corresponding return space is formed by the stop ring 20.

Figure 6:
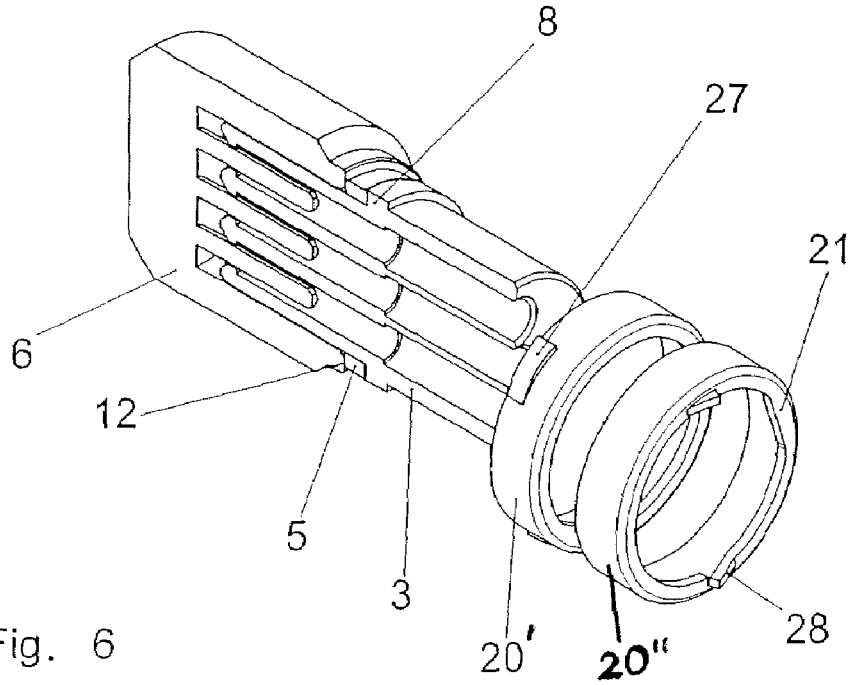
FIG. 6 shows a side perspective view in section of the electrical connector shown in FIGS. 5*a* and 5*b;*

FIG. 6 shows that the stop ring 20 is used not only to limit the maximum screw-down path of the union nut 4, but also together with the union nut 4 can be used as a vibration guard. FIG. 6 shows two versions of the stop ring 20' and stop ring 20". In the first version, the stop ring 20' has several protruding ramp-shaped projections 27 that are uniformly distributed over the periphery and together with the union nut 4 act as a radial vibration guard. In the second version of stop ring 20", several spring tongues 28 are formed that are disengaged from the end-side shoulder 21 of the stop ring 20". Based on the ramp-shaped configuration of the projections 27 and the spring tongues 28, a direction-dependent vibration guard is also ensured in this configuration, which on the one hand makes the screwing of the union nut 4 onto the mating connector 6 only slightly more difficult, but on the other hand reliably prevents protection against unintentional loosening of the union nut 4 as a result of vibrations since the force required for unscrewing is distinctly greater.

Figure 7:
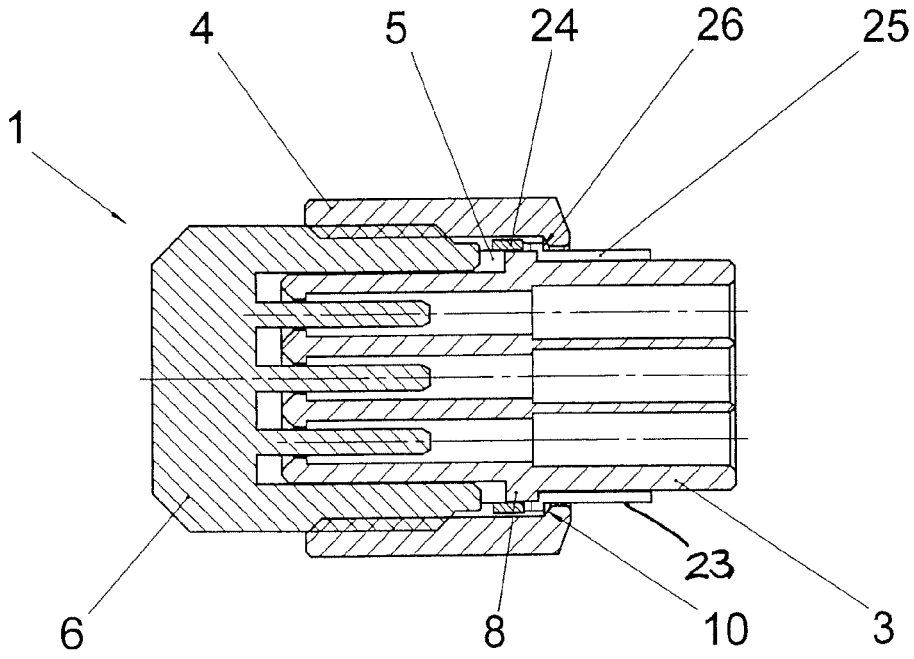
FIG. 7 shows is a side view in section of another preferred embodiment of the electrical connector.

The corresponding also applies to the electrical connector 1 shown in FIG. 7, which uses a stop sleeve 23 instead of a stop ring 20. The stop sleeve 23 has two sections 24 and 25. The first section 24 faces the mating connector 6 and has a greater diameter than the second section 25 so that the first section 24 radially surrounds the collar 8 on the contact carrier 3. The stop sleeve 23 is located on the contact carrier 3 such that a shoulder 26 that connects the two sections 24, 25, similar to the end side shoulder 21 of the stop ring 20, extends behind first face side 9 and beyond the second face side 11 of the contact carrier 3. The shoulder 26 of the stop sleeve 23 and the shoulder 21 of the stop ring 20 are thus located between the face side 9 of the collar 8 and the end-side shoulder 10 of the union nut 4. The union nut 4 does not act directly on the collar 8 of the contact carrier 3, but only indirectly via the shoulder 21 or 26 of the stop ring 20 or the stop sleeve 23. This has the advantage that the generally metal union nut 4 does not press on the generally plastic contact carrier 3, but instead presses on the likewise metal stop ring 20 or the stop sleeve 23.

Figure 8A:
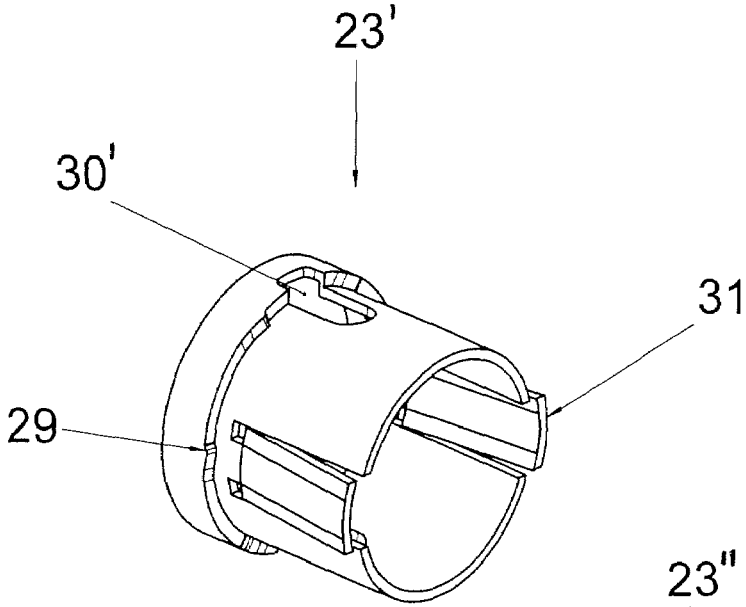
FIG. 8*a* shows a side perspective view of an embodiment of the stop sleeve of the electrical connector shown in FIG. 7.
Figure 8C:
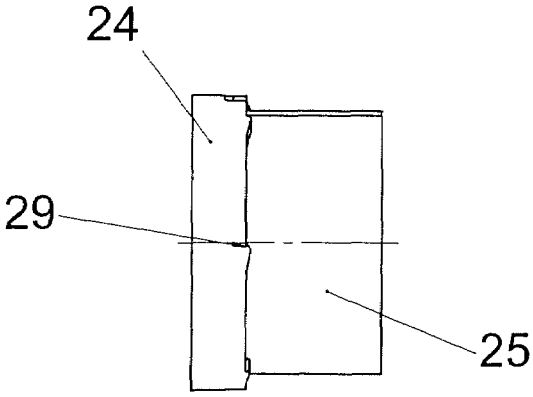
FIG. 8*c* shows a side view of the stop sleeve shown in FIG. 8*b;*

In the electrical connector shown in FIG. 7, the stop sleeve 23 is used simultaneously as a limit for the maximum screw-down path and as a vibration guard. In the variation of the stop sleeve 23' shown in FIG. 8*a*, the face side 29 of the shoulder 26 facing the end-side shoulder 10 of the union nut 4 is provided with a sawtooth surface. The sawtooth surface of the face side 29 has the same function as the spring tongues 28 that are formed on the stop ring 20 as shown in FIG. 6.

Figure 8B:
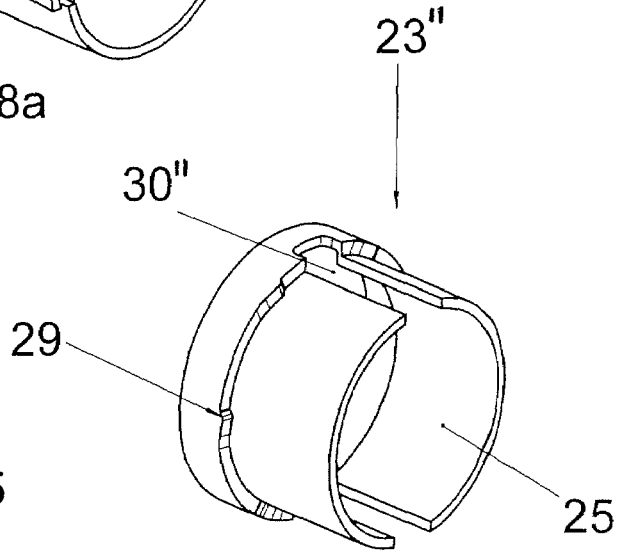
FIG. 8*b* shows a side perspective view of another embodiment of the stop sleeve of the electrical connector shown in FIG. 7.
Figure 9A:
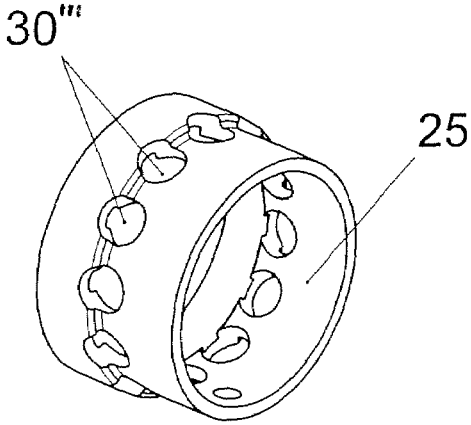
FIG. 9*a* shows a side perspective view of another version of a stop sleeve for the electrical connector shown in FIG. 7.
Figure 9B:
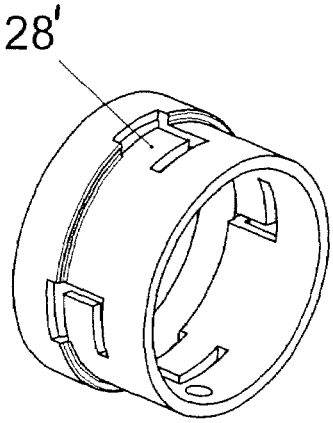
FIG. 9*b* shows a side perspective view of another version of a stop sleeve for the electrical connector shown in FIG. 7.

In addition, in the stop sleeves 23' and 23", seen in FIG. 8*b*, several openings 30' and 30" are formed, especially be being punched out, which are distributed over the periphery and are used as torsion protection of the stop sleeves 23' and 23" to the contact carrier 3. As is apparent from the stop sleeves shown in FIGS. 8*a*, 8*b*, and also 9*a* and 9*b*, the openings 30', 30", 30'" can have different configurations and can be both closed and open on one side. In addition, for the stop sleeve 23' shown in FIG. 8*a*, there are two notches 31 that are optionally used for making contact with the cable shielding braid. Instead of the surface of the face side 29 of the shoulder 26 of the stop sleeve 23, which has a sawtooth structure, several spring tongues 28' can also be punched out in the stop sleeve, as shown in FIG. 9*b*, which act as a radial vibration guard likewise together with the union nut 4.

Figure 10A:
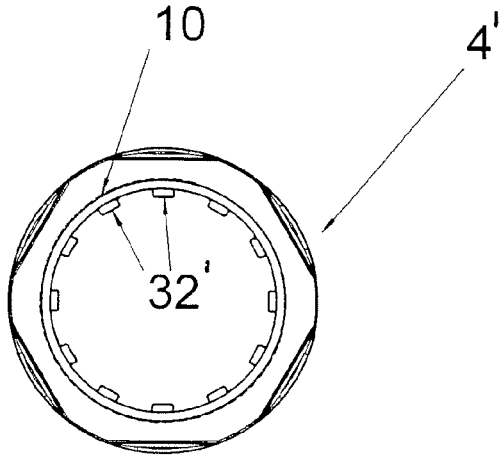
FIG. 10*a* shows a top view of a version of a union nut for the electrical connector.
Figure 10B:
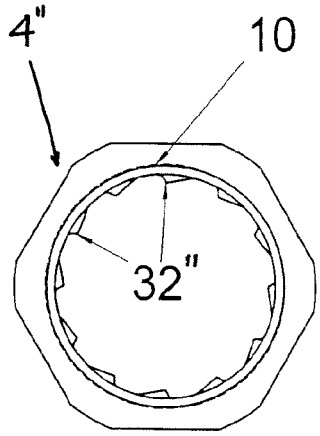
FIG. 10*b* shows a top view of another version of a union nut for the electrical connector.

FIGS. 10*a* and 10*b* show two versions of the union nut 4' and 4", which have a different configuration of the end-side shoulder 10. In both of the union nuts 4' and 4", the end-side shoulder 10 has teeth that project to the inside, with the teeth 32' of the union nut 4' shown in FIG. 10*a* being made as uniform knurling, while the teeth 32" of the union nut 4 shown in FIG. 10*b* run in a sawtooth shape. When the union nut 4', seen in FIG. 10*a,* interacts with the stop sleeve shown in FIG. 9*b,* the spring tongues 28' act as a direct-dependent vibration guard. This vibration guard effect is also realized by the interaction of the union nut 4" shown in FIG. 10*b* with the stop sleeve shown in FIG. 9*a* that has a plurality of round openings 30'''.

Figure 11:
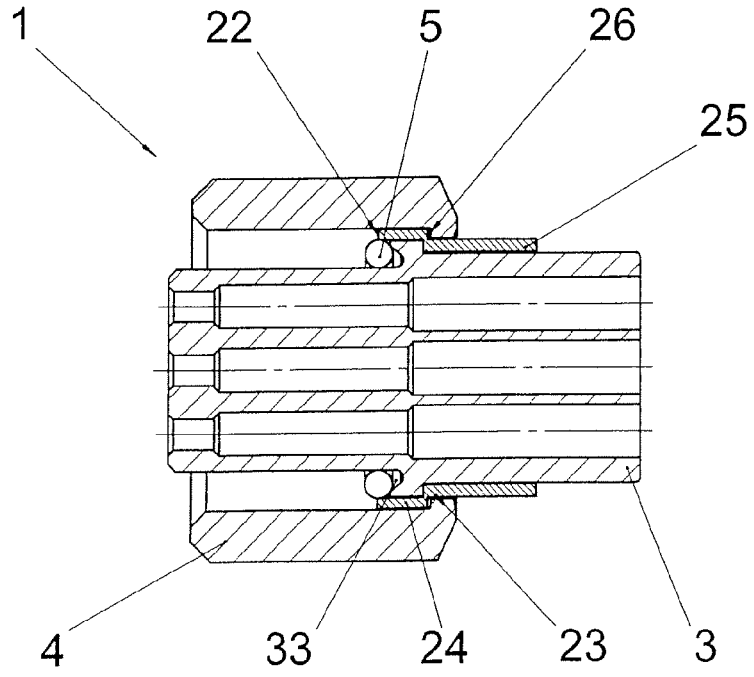
FIG. 11 shows a side view in section of a version of the electrical connector shown in FIG. 7.

FIG. 11 shows an electrical connector 1 which corresponds in terms of its basic structure to the connector 1 as shown in FIG. 7. In particular, the electrical connector 1 shown in FIG. 11 has a stop sleeve 23 that, on the one hand, limits the maximum screw-down path of the union nut 4, and, on the other hand, forms a vibration guard together with the union nut 4. In the version shown in FIG. 11, in contrast to the version as shown in FIG. 7, the mating connector 6 is not shown. The difference between the electrical connector 1 shown in FIG. 7 and the connector 1 shown in FIG. 11 is that on the second end side 11 of the collar 8 facing the mating connector 6 on the contact carrier 3 there is a free space 33 for the elastic sealing element 5. The face side 11 of the collar 8 is thus not made flat, but has a groove which forms the free space 33. When the union nut 4 is screwed down onto the mating connector 6, pinching of the sealing element 5 between the front face side of the stop sleeve 23 and the face side 12 of the mating connector 6 is prevented, since the sealing element 5 that is compressed during screw-down can deflect at least partially into the free space 33.

Figure 12A:
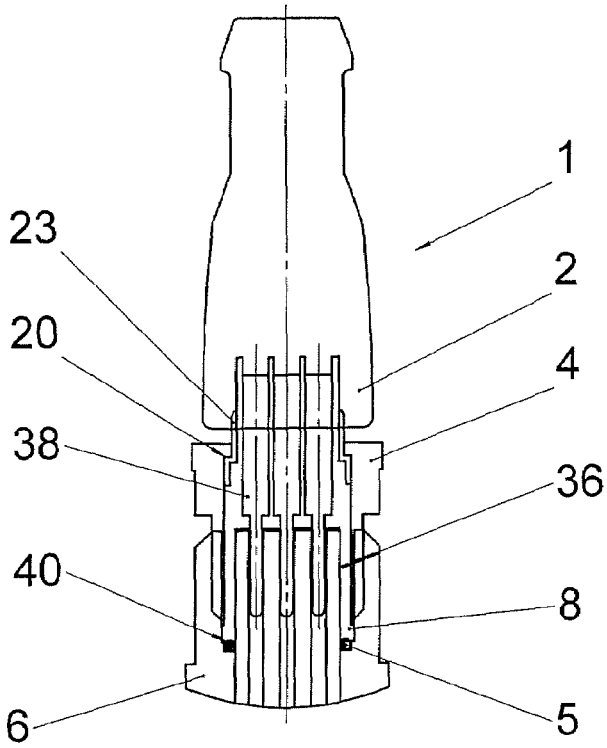
FIG. 12*a* shows a side view in section of an embodiment of an electrical plug and socket connection, with a connector and a mating connector.
Figure 12B:
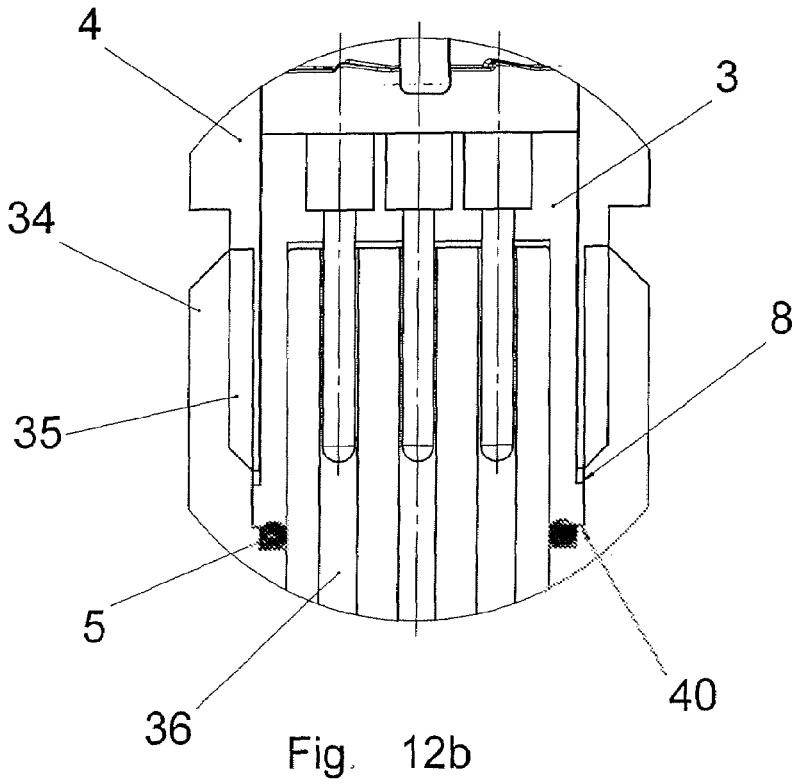
FIG. 12*b* shows an enlarged view of the connection of FIG. 12*a;*.

FIGS. 12*a* and 12*b* show an electrical plug and socket connection in accordance with the invention with the connector 1 and the mating connector 6. The connector in FIGS. 12*a* and 12*b* differs essentially from the connector 1 of FIGS. 1 to 7 and 11 only in that the union nut 4 has an outside thread, rather than an inside thread, and that the collar 8 is made not in the middle area of the contact carrier 3, but only on its face side facing the mating connector 6. In this embodiment, the electrical connector 1 thus does not constitute the socket, but rather is the plug of the electrical plug and socket connection. Accordingly, the mating connector 6 has an outside sleeve 34 with an inside thread 35, and the contact carrier 3 is surrounded by the outside sleeve 34, which is made as a socket. The contacts located in the mating connector 6 are made as sockets 36, while the contacts in the contact carrier 3 of the connector are formed by the corresponding contact pins 38.

Based on the configuration of the electrical connector 1 as the plug and of the mating connector 6 as the socket, the elastic sealing element 5 is now located on the mating connector 34 with the sealing element 5 being located within the mating connector 6 on the thread base 35.

To limit the maximum screwing path of the union nut 4 into the outside sleeve 34 of the mating connector 6, in the electrical plug and socket connection there is a stop, the stop being formed by a shoulder 40 which is made on the thread base 35 of the mating connector 6. The shoulder 40 limits the maximum screw-in depth of the union nut 4, by which sufficient return space is made available to the sealing element 5 so that intentional compression, but not "overpressing" of the sealing element 5, occurs.

As described above in conjunction with the electrical connector 1, in the electrical plug and socket connection there is a vibration guard which in the illustrated embodiment is implemented between the stop sleeve 23 and the union nut 4. For this purpose, the face side 29 of the shoulder 26 of the stop sleeve 23 is provided with a sawtooth surface which interacts with the teeth 32 made on the union nut 4, as described above.

Figure 13:
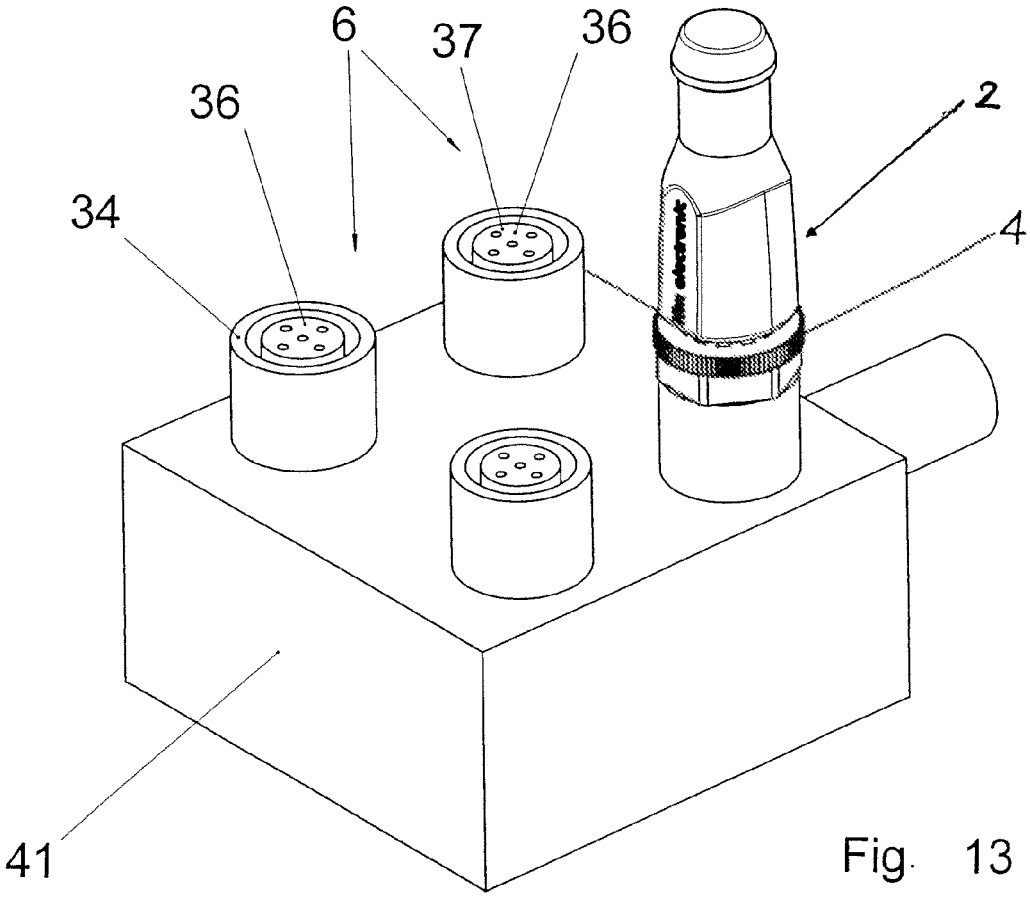
FIG. 13 shows a perspective view of a distributor box with an electrical plug and socket connection as shown in FIG. 12*a.*

FIG. 13 shows a sample application of an electrical plug and socket connection. In this case, there are four mating connectors 6 jointly on a cable splitting box 41. This embodiment is thus a "fixed" plug and socket connection in which the "free" electrical connector 1 connected to a cable is connected to the "stationary" mating connector 6. So-called "loose" plug and socket connections are also known in which a "free" electrical connector 1 connected to a cable is connected to a likewise "free" mating connector 6 to which likewise a cable is connected.

Modifications and changes to the invention described herein can be made and remain within the scope of the invention as defined in the appended claims.

What is claimed is:

1. An electrical connector assembly, comprising:

an electrical connector including a handle body for surrounding a cable set and a contact carrier having an outside periphery and a peripheral collar with first face side and a second face side;

a union nut having an inside surface and an end-side shoulder, wherein the union nut is rotatable and axially displaceable to a limited degree on the contact carrier;

an elastic sealing element located on the contact carrier; and a mating connector having an outside sleeve with a thread and a face side, wherein the union nut can be screwed onto the thread formed on the outside sleeve of the mating connector, and the first face side of the peripheral collar is used as a first stop for the end-side shoulder of the union nut and the second face side faces the mating connector and forms a second stop for the sealing element, wherein the sealing element is located between the collar of the contact carrier and the face side of the mating connector, such that the sealing element is compressed, and wherein a third stop is provided to limit a maximum path by which the union nut can be screwed onto the mating connector such that when the union nut is screwed on, the elastic sealing element is compressed a limited extent.

2. The electrical connector assembly as claimed in claim 1, wherein the third stop is formed on the inside surface of the union nut.

3. The electrical connector assembly as claimed in claim 1, wherein the third stop is formed on the outside periphery of the contact carrier.

4. The electrical connector assembly as claimed in claim 1, further comprising a retaining element located on the contact carrier, wherein the retaining element and the union nut form a vibration guard, so that a force required to screw the union nut tightly onto the thread of the mating connector is less than a force required to unscrew the union nut.

5. The electrical connector assembly as claimed in claim 4, wherein the retaining element is an open spring washer.

6. The electrical connector assembly as claimed in claim 4, wherein the retaining element is a retaining ring.

7. The electrical connector assembly as claimed in claim 1, wherein the third stop is formed by an additional component located at least partially between the contact carrier and the union nut, wherein the additional component has a face side that interacts with the face side of the mating connector.

8. The electrical connector assembly as claimed in claim 7, wherein the additional component is formed of metal and forms a vibration guard with the union nut, so that a force required to screw the union nut tightly onto the thread of the mating connector is less than a force required to unscrew the union nut.

9. The electrical connector assembly as claimed in claim 7, wherein the additional component is a ring and is connected to the sealing element, wherein the ring and the sealing are located between the collar of the contact carrier and the face side of the mating connector.

10. The electrical connector assembly as claimed in claim 9, wherein the ring is an open metal ring that radially surrounds the sealing element so that the ring widens when the sealing element is compressed, and wherein the ring has an outer periphery with ribs formed thereon.

11. The electrical connector assembly as claimed in claim 7, wherein the additional component is made as a stop ring located on the contact carrier and having an end-side shoulder that extends behind the second face side of the collar of contact carrier.

12. The electrical connector assembly as claimed in claim 7, wherein the additional component is a stop sleeve having a first section facing the mating connector with a larger diameter and a second section with a smaller diameter connected by a shoulder, wherein the stop sleeve is located on the contact carrier such that the shoulder of the stop sleeve extends behind the first face side of the contact carrier.

13. The electrical connector assembly as claimed in claim 12, wherein the shoulder of the stop sleeve has a face side facing the union nut that has a sawtooth surface.

14. The electrical connector assembly as claimed in claim 12, wherein the stop sleeve has openings formed therein distributed over its periphery.

15. The electrical connector assembly as claimed in claim 7, wherein the additional component includes protruding ramp-shaped elements that form a direction-dependent vibration guard with the union nut and is formed of metal.

16. The electrical connector assembly as claimed in claim 1, wherein the end-side shoulder of the union nut has teeth or knurling that project inwardly.

17. The electrical connector assembly as claimed in claim 1, wherein a groove is formed on the second face side of the collar of the contact carrier facing the mating connector to define a free space for the sealing element when the union nut is screwed tight.

* * * * *